US010566118B2

(12) United States Patent
Takeoka et al.

(10) Patent No.: US 10,566,118 B2
(45) Date of Patent: Feb. 18, 2020

(54) COIL COMPONENT

(71) Applicant: TAIYO YUDEN CO., LTD., Taito-ku, Tokyo (JP)

(72) Inventors: Shinsuke Takeoka, Takasaki (JP); Akiko Yamaguchi, Takasaki (JP); Kenji Otake, Takasaki (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 423 days.

(21) Appl. No.: 15/087,612

(22) Filed: Mar. 31, 2016

(65) Prior Publication Data

US 2016/0293321 A1 Oct. 6, 2016

(30) Foreign Application Priority Data

Mar. 31, 2015 (JP) ..... 2015-073481

(51) Int. Cl.
*H01F 1/14* (2006.01)
*H01F 17/04* (2006.01)
*H01F 27/255* (2006.01)

(52) U.S. Cl.
CPC ..... *H01F 1/14* (2013.01); *H01F 27/255* (2013.01)

(58) Field of Classification Search
CPC ..... H01F 17/04; H01F 1/14
See application file for complete search history.

(56) References Cited

U.S. PATENT DOCUMENTS

2013/0194060 A1* 8/2013 Nakada ..... H01F 27/00 336/192
2014/0049348 A1* 2/2014 Matsuura ..... H01F 1/14783 336/177

FOREIGN PATENT DOCUMENTS

| | | | | |
|---|---|---|---|---|
| CN | 102610362 A | | 7/2012 | |
| CN | 103295761 A | | 9/2013 | |
| CN | 103415902 A | | 11/2013 | |
| JP | 2010118587 A | | 5/2010 | |
| JP | 2015061052 A | | 3/2015 | |
| KR | 20140007959 A | * | 1/2014 | ..... H01F 1/34 |
| KR | 20140007959 A | * | 1/2014 | |

(Continued)

OTHER PUBLICATIONS

KR20140007959A, Jan. 2014, Machine Translation.*

(Continued)

*Primary Examiner* — Elvin G Enad
*Assistant Examiner* — Malcolm Barnes
(74) *Attorney, Agent, or Firm* — Law Office of Katsuhiro Arai

(57) ABSTRACT

In an embodiment, a coil component includes a magnetic body, and an internal conductor 21 having a center axis and formed in a spiral shape; wherein the internal conductor 21 is embedded in the magnetic body; in a cross sectional view of a plane that includes the center axis extending in the vertical direction, wherein a conductor region part 11 positioned between the adjacent windings of the spiral shape has a higher oxygen content than that of a core part 12 including the center axis and positioned on the inner side of the windings of the spiral shape. the magnetic body is constituted by iron-based soft magnetic grains and oxide film of at least one type of element that oxidizes more easily than iron, which oxide film bonds at least partly the iron-based soft magnetic grains.

3 Claims, 1 Drawing Sheet

(56) References Cited

FOREIGN PATENT DOCUMENTS

| | | | |
|---|---|---|---|
| KR | 1020140007959 | A | 1/2014 |
| KR | 1020140052945 | A | 5/2014 |

OTHER PUBLICATIONS

A Notification of Reason for Refusal issued by Korean Intellectual Property Office, dated Jun. 21, 2017, for Korean counterpart application No. 1020160036879.

A First Office Action with search report issued by the State Intellectual Property Office of China dated May 26, 2017 for Chinese counterpart application No. 201610202409.0.

* cited by examiner

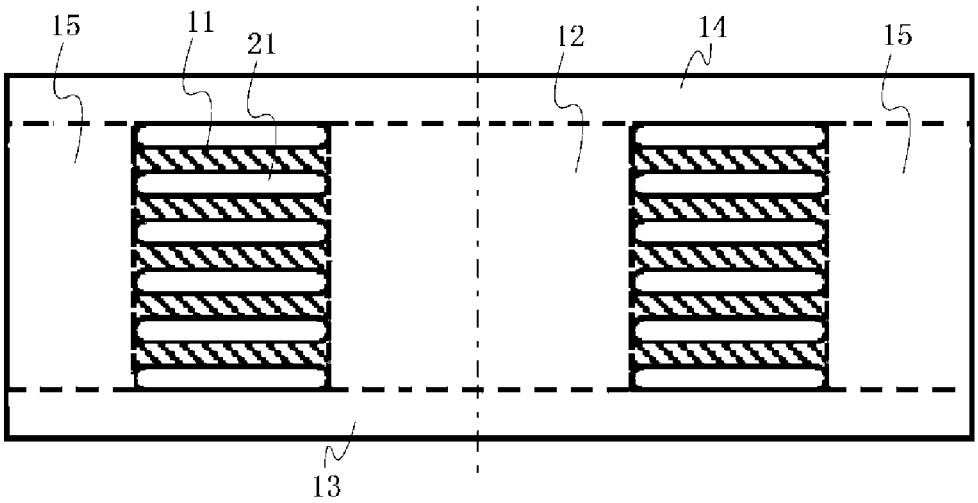
15
11
21
12
14
15
13

COIL COMPONENT

BACKGROUND

Field of the Invention

The present invention relates to a coil component, one representative example of which is a laminated inductor.

Description of the Related Art

Inductor components are increasingly designed with higher current ratings while facing a demand for supporting higher frequencies in recent years. To respond to the call for higher current ratings, switching materials from ferrite materials to metal materials such as Fe and alloys is being studied. When these metal materials are used, a conventional approach has been to bond magnetic grains using resin or glass or sinter the magnetic grains together. If resin is used, however, more resin must be added to ensure strength and consequently the packing ratio of magnetic grains drops and sufficient magnetic permeability cannot be achieved. On the other hand, sintering achieves high magnetic permeability, but it puts limitations in terms of frequencies due to the effect of loss, which in turn limits the applicability of this method to electronic components used for mobile devices, etc. In light of the above, methods not using resin or glass have been studied and it has been shown that, by oxidizing magnetic grains to form oxide film on the surface of grains and then binding the magnetic grains together by this oxide film, a magnetic body of high packing ratio can be produced.

The invention disclosed in Patent Literature 1 comprises a compact with built-in coil that uses a metal magnetic body constituted by metal magnetic powder whose surface is covered with glass. The surface of the compact is covered with ceramics. Also, the ceramic surface of the compact is impregnated with resin.

BACKGROUND ART LITERATURES

[Patent Literature 1] Japanese Patent Laid-open No. 2010-118587

SUMMARY

For a laminated inductor, etc., a powder compact achieving higher packing and superior saturation characteristics than heretofore achievable is desired. However, a manufacturing process that involves layering of green sheets, etc., for example, limits the pressures that can be applied. This is to prevent the internal conductors in the laminated body from deforming or breaking due to pressure. There are also concerns that the highly packed magnetic grains may cause insulation property to drop.

In consideration of the above, an object of the present invention is to provide a coil component offering both high insulation property and high magnetic permeability in situations where further size reduction and thickness reduction is anticipated.

Any discussion of problems and solutions involved in the related art has been included in this disclosure solely for the purposes of providing a context for the present invention, and should not be taken as an admission that any or all of the discussion were known at the time the invention was made.

After studying in earnest, the inventors of the present invention completed an invention of a coil component characterized as described below. According to the present invention, the coil component comprises a magnetic body, and an internal conductor having a center axis and formed in a spiral shape. The internal conductor is embedded in the magnetic body. In a cross sectional view of a plane that includes the center axis of the spiral of the internal conductor extending in the vertical direction, the magnetic body can be divided into a conductor region part, core part, cover parts, and side part. Here, the conductor region part is positioned between the adjacent windings of the spiral shape. The core part includes the center axis and is positioned on the inner side of the windings of the spiral shape. The cover parts are positioned below the bottom edge, and above the top edge, of the spiral shape. The side part is positioned on the exterior of the windings of the spiral shape. The magnetic body is constituted by iron-based soft magnetic grains and oxide film of an element that oxidizes more easily than iron. Here, bonding of the iron-based soft magnetic grains positioned adjacent to each other is formed at least partly by the oxide film. The oxygen content of the conductor region part is higher than that of the core part.

Preferably the oxygen content of the conductor region part is higher than that of the side part.

Separately, the internal conductor preferably contains at least one of Ag and Cu.

According to the invention, a coil component offering excellent magnetic permeability and good inductance characteristics can be obtained, capable of ensuring insulation property due to a high oxygen content of the conductor region part near the internal conductor, while achieving a higher metal percentage of the magnetic grains as a result of keeping the oxygen content of the core part low. Also, such good characteristics can be utilized to help reduce the thickness of the coil component.

For purposes of summarizing aspects of the invention and the advantages achieved over the related art, certain objects and advantages of the invention are described in this disclosure. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description which follows.

BRIEF DESCRIPTION OF THE DRAWINGS

These and other features of this invention will now be described with reference to the drawings of preferred embodiments which are intended to illustrate and not to limit the invention. The drawings are greatly simplified for illustrative purposes and are not necessarily to scale.

FIG. 1 is a schematic cross sectional view of a coil component.

DESCRIPTION OF THE SYMBOLS

11: Conductor region part, 12: Core part, 13, 14: Cover part, 15: Side part, 21: Internal conductor

DETAILED DESCRIPTION OF EMBODIMENTS

The present invention is described in detail below by referring to the drawings as deemed appropriate. It should be noted, however, that the present invention is not limited to the illustrated mode and that accuracy of scale is not necessarily assured in each part of the drawings because the characteristic parts of the invention may be emphasized in the drawings.

FIG. 1 is a schematic cross sectional view of a laminated inductor representing a typical example of a coil component. In the explanations below, a laminated inductor is cited as a specific embodiment of a coil component to which the present invention is applied, but the coil component may be a transformer, common mode filter for power supply, or the like, for example. The laminated inductor is structured in such a way that its internal conductor 21 is embedded in a magnetic body (laminated body constituted by magnetic layers). Typically, the internal conductor 21 is a coil formed in a spiral shape, where other examples include a conductive wire of helical coil type, etc. The spiral shape formed by the internal conductor 21 has a center axis, and this center axis is represented by an alternate long and short dashed line in FIG. 1.

With the laminated inductor being a coil component, normally planar sheets are layered on each of which a conductor pattern shorter than one winding of the spiral shape is formed, and then the planar sheets are made conductively connected through via holes, etc., to form the internal conductor 21. There are coil and relay segments. Via holes are not illustrated, but conductive patterns formed on the planar sheets are shown, in FIG. 1. Conductive lead wires (not illustrated) extend from both ends of the internal conductor 21 to the exterior surface of the coil component, etc., to achieve electrical conductivity to the outside.

As to the conductive material for the internal conductor 21, any of the various materials traditionally used as electrodes for electronic components can be used without limitation. Typically Ag or Cu is used, but preferably Ag or Cu containing virtually no other metal is used. Or, a mixture or alloy containing 100 parts by weight of Ag and 50 parts by weight or less of other metal may be used, where examples of the other metal include, but are not limited to, Au, Cu, Pt, and Pd.

The magnetic body (denoted by symbols 11 to 15 in FIG. 1) as a whole is understood as an assembly of many originally independent iron-based soft magnetic grains that are bonded to each other. The magnetic body can also be described as a powder compact constituted by many iron-based soft magnetic grains. At least some iron-based soft magnetic grains have oxide film (not illustrated) formed at least partially around, and preferably almost all around, their circumference, and this oxide film ensures insulation property of the magnetic body (through oxide-to-oxide bonding). The adjacent iron-based soft magnetic grains are primarily bonded together via the oxide film around each of the iron-based soft magnetic grains, and a magnetic body having a specific shape is constituted as a result. The adjacent iron-based soft magnetic grains may be bonded partly together at their metal parts (metal-to-metal bonding, metallic bonding). Conventional magnetic bodies use a matrix of cured organic resin in which magnetic grains or coupled magnetic grains each consisting of several or so magnetic grains are distributed, or a matrix of cured glass component in which magnetic grains or coupled magnetic grains each consisting of several or so magnetic grains are distributed. Under the present invention, preferably no virtually organic resin matrix or glass component matrix exists in those parts where iron-based soft magnetic grains are bonded together.

Each individual iron-based soft magnetic grain is a grain containing at least iron (Fe) and exhibiting soft magnetism, and may be an alloy grain or contain an iron grain. Preferably it is constituted by an alloy containing iron and at least one type of metal element that oxidizes more easily than iron (generally referred to as "M" under the present invention). M is typically Cr (chromium), Al (aluminum), or Ti (titanium), for example, and preferably Cr or Al. The iron-based soft magnetic grain may contain Si. The magnetic body may contain sulfur (S) or silicate (Si).

The chemical composition of the magnetic body can be calculated by the ZAF method based on energy dispersion X-ray spectroscopy (EDS), by capturing a cross section of the magnetic body using a scanning electron microscope (SEM).

Metal elements that can be contained other than Fe, Si, and M include Mn (manganese), Co (cobalt), Ni (nickel), Cu (copper), P (phosphorus), and C (carbon), for example. Preferably the magnetic body is constituted by Fe, metal element M, Si, and oxygen atoms.

Some of the individual iron-based soft magnetic grains constituting the magnetic body have oxide film formed at least partially around their circumference. The oxide film may be formed before the magnetic body is compacted, or specifically in the stage where it is still in a state of material magnetic grains (hereinafter also referred to as "material grains"), or the oxide film may be produced in the compacting process by keeping the oxide film non-existent or at a minimum in the material grains stage, or the material grains may be coated with an oxide that oxidizes more easily than Fe or mixed with fine grains of such oxide. Preferably the oxide film is formed by the oxide of the iron-based soft magnetic grain itself. In other words, preferably no material other than the aforementioned iron-based soft magnetic grains is added separately to form oxide film. When the compacted iron-based soft magnetic grains are heat-treated to obtain a magnetic body, preferably the surface of the iron-based soft magnetic grains oxidizes and oxide film is produced and multiple iron-based soft magnetic grains are bonded together via the produced oxide film. Presence of oxide film can be recognized as a contrast (brightness) difference on an image captured with a scanning electron microscope (SEM) at around ×5000 magnifications. Presence of oxide film assures insulation property of the magnetic body as a whole.

Preferably the mol ratio of the elemental metal denoted by M above, to elemental Fe, is greater with the oxide film than with the iron-based soft magnetic grain. Methods to obtain oxide film of such constitution include, for example, oxidizing the surface of magnetic grains by heat treatment, etc., in the process of obtaining a magnetic body, by keeping the presence of Fe oxide on the material grains for magnetic body as little as possible or by keeping the material grains as free of Fe oxide as possible. When treated this way, metal M that oxidizes more easily than Fe is selectively oxidized and consequently the mol ratio of metal M to Fe with the oxide film becomes relatively greater than the mol ratio of metal M to Fe with the iron-based soft magnetic grain. The fact that the oxide film contains more of the metal element denoted by M than the Fe element is beneficial in that excessive oxidization of alloy grains is suppressed.

The method for measuring the chemical composition of the oxide film in the magnetic body is described below. First, the magnetic body is fractured or otherwise its cross section is exposed. Next, the surface is smoothed by ion milling, etc., and then captured with a scanning electron microscope (SEM), followed by energy dispersion X-ray spectroscopy of areas where there is oxide film, and calculation of the result according to the ZAF method.

In the magnetic body, iron-based soft magnetic grains are bonded together primarily via oxide film. Presence of bonds via oxide film (not illustrated) can be clearly determined using, for example, a SEM-observed image magnified to approx. 5000 times. Presence of bonds via oxide film leads to improved mechanical strength and insulation property. Preferably adjacent iron-based soft magnetic grains are bonded together via their oxide film throughout the magnetic body, but considerable improvement in mechanical strength and insulation property can be achieved so long as the grains are bonded this way at least partially, and this mode is also considered an embodiment of the present invention. Additionally, iron-based soft magnetic grains may be partially bonded together not via oxide film. Furthermore, a mode where adjacent iron-based soft magnetic grains are simply contacting or close to each other physically, where there are no bonds via oxide film or direct bonds of iron-based soft magnetic grains, may be partially present. Moreover, the magnetic body may have voids in some parts. In addition, resin, etc., may be impregnated to fill the voids.

Methods to produce bonds via oxide film include, for example, applying heat treatment at the specified temperature mentioned later in an ambience of low oxygen content where oxygen is present, when the magnetic body is manufactured.

Presence of direct bonds of iron-based soft magnetic grains mentioned above can be visually recognized using, for example, a SEM-observed image (photograph of cross section) magnified to approx. ×5000 magnifications. Presence of direct bonds of iron-based soft magnetic grains leads to improved magnetic permeability.

Methods to produce direct bonds of iron-based soft magnetic grains include, for example, using material grains having less oxide film, adjusting the temperature and oxygen content as described later for the heat treatment applied to manufacture the magnetic body, and adjusting the compacting density when the magnetic body is obtained from the material grains.

The composition of the material grain will be reflected in the alloy composition of the magnetic body to be finally obtained. Accordingly, the composition of the material grain may be selected as deemed appropriate according to the composition of the magnetic body to be finally obtained, and its favorable composition range is the same as the favorable composition range for the magnetic body mentioned above.

The sizes of individual material grains are virtually equal to the sizes of the grains constituting the magnetic material part of the magnetic body to be finally obtained. The sizes of material grains are preferably 2 to 30 μm based on d50 when magnetic permeability and in-grain eddy current loss are considered. The d50 of the material grain can be measured using a laser diffraction/scattering measuring apparatus.

Preferably the magnetic grains used as material are manufactured according to the atomization method. According to the atomization method, Fe being the primary material, and Cr, Al, Si, FeS (iron sulfate), etc., as necessary, are added and melted in a high-frequency melting furnace. Here, the weight ratio of each component is checked. Magnetic grains can be obtained from the material thus obtained, according to the atomization method. Iron grains may also be in a form of carbonyl iron powder. Carbonyl iron powder is characterized by high Fe purity and small grain size, so when mixing alloy grains and iron grains, oxide film can be formed in a stable manner by using iron grains whose diameters are smaller than those of alloy grains.

Under the present invention, the magnetic body can be divided into four areas as described below. Here, the term "divide" is not used to limit the manufacturing sequence, etc., but it only means that the magnetic body can be understood as the separate areas described below. To divide the magnetic body, a cross sectional view of a coil component like the one shown in FIG. 1 is considered. Here, the section view must include the center axis of the spiral shape formed by the internal conductor 21, and must be considered in the orientation in which this center axis extends vertically. In the following text, the terms representing directionality, such as "vertical," refer to directionality in consideration of a section view like the one mentioned above. "Inner side" refers to the direction of approaching the center axis in the coil component, while "outer side" refers to the direction toward the exterior surface of the coil component.

The first area consists of a conductor region part 11. The conductor region part 11 is the area positioned between the adjacent windings of the spiral shape formed by the internal conductor 21. In the case of a laminated inductor, for example, it is the area between two adjacent layers on each of which a conductor pattern is formed.

The second area consists of a core part 12. The core part 12 is the area that includes the center axis on the inner side of the spiral shape formed by the internal conductor 21. It should be noted, however, that an area positioned inside this area but constituting a part of the cover part 13 or 14 mentioned below, is not recognized as the core part.

The third area consists of cover parts 13, 14. The cover part 13 is the area positioned below the bottom edge of the internal conductor 21. The cover part 14 is the area positioned above the top edge of the internal conductor 21.

The fourth area consists of a side part 15. The side part 15 is the area positioned on the outer side of the internal conductor 21. It should be noted, however, that an area present on the outer side of the internal conductor 21 but constituting a part of the cover part 13 or 14 mentioned above is not recognized as the side part 15.

According to the present invention, the oxygen content of the conductor region part 11 is higher than that of the core part 12. The quantitative measures of oxygen contents are compared by the EDS mentioned above. To be specific, the comparison of quantitative measures follows the steps below. The obtained laminated body is polished so that it runs in parallel with the center axis and is shaved almost to a position where the center axis runs. Thereafter, the shaved surface is ion-milled. This way, cross sections of the magnetic body cutting through the conductor region part 11, core part 12, cover parts 13, 14, and side part 15 become visible. The oxygen content is obtained by analyzing each of these cross sections. The analysis method involves map analysis using SEM-EDS and WDS, which allows for comparison between the surface oxide film of the material grain inside the internal electrodes of the conductor region part 11, and the surface oxide film of the material fine grain at the center of the core part 12. Numerical comparison is also possible using the SEM-EDS ZAF method. From the Fe and O (oxygen) detected per unit area, the O/Fe ratio is obtained and the greater value of O/Fe represents the higher oxygen content. At this time, each analysis should be conducted at the same settings to ensure good analysis accuracy.

First, the conductor region part indicates the part sandwiched between the top internal conductor and the bottom internal conductor on the opposite side. Here, magnifications are set so that the conductor region part 11 sandwiched between the internal conductors fits the view field, and other settings are also fixed. Thereafter, the view field is moved until the core part is inside it, and analysis is conducted in the same manner.

Also, the oxygen content relates to the thickness of the oxide film between the iron-based soft magnetic grains. Additionally, the metal percentage of the soft magnetic grain is indicated as a value in a trade-off relationship with the thickness of oxide film. The higher the oxygen content, the lower the metal percentage of the magnetic grain, and the lower the oxygen content, the higher the metal percentage. This oxygen content indicates the percentage of oxide, other than metal, in the magnetic grain, and is affected by the thickness of oxide film. In other words, the magnetic characteristics of the magnetic body can be determined by the thickness of oxide film between the magnetic grains. This can be achieved by applying heat treatment under a condition of low oxygen concentration.

The thickness of oxide film is measured using the aforementioned evaluation sample for oxygen content. Here, the thickness of oxide film is evaluated at the conductor region part 11 to check insulation property. First, using a SEM (scanning electron microscope) at ×100 to ×200 magnifications, a location corresponding to the center of the cross section of the conductor region part 11 is determined in the same manner as explained above, and a magnetic grain near the center is selected. Next, the magnifications are adjusted to a range of ×10000 to ×20000 and then a tangential line is drawn between the selected magnetic grain and another magnetic grain positioned adjacent to the selected magnetic grain via oxide film, and by viewing from the direction orthogonal to the tangential line, a line orthogonal to the tangential line is drawn to the part where the distance between the selected magnetic grain and the adjacent magnetic grain joined to it via oxide film becomes the closest, after which line analysis is conducted using an EDS (energy dispersion X-ray spectrometer) on this line. The range of analysis is set as 0.5 to 1 μm to both sides of the point of intersection between the tangential line and the orthogonal line, and by using the smaller of the O/Fe's at both ends as a reference, the length of the part where the value of O/Fe became 1.2 times the reference or more is obtained. Here, there may be multiple adjacent magnetic grains, in which case measurement is performed with respect to each of them. This measurement is performed more than 10 times sequentially, starting from the magnetic grain closest to the center, and an average is obtained. The method for selecting the magnetic grains close to the center involved drawing a circle around the center and then selecting magnetic grains from among those covered by the circle, starting from the one having the smallest radius.

Also, for the sake of checking insulation property, magnetic grains whose grain size was 1 μm or more in both the X direction and Y direction based on contrast on a SEM observed image, and which were not iron grains, are randomly selected and evaluated.

By increasing the oxygen content of the conductor region part 11, insulation property is ensured and the interval between internal conductors 21 can be shortened, and by lowering the oxygen content of the core part 12, the metal percentage of the iron-based soft magnetic grain can be increased and higher magnetic permeability can be achieved. As a result, these can help reduce the thickness of the coil component.

Preferably the oxygen content of the conductor region part 11 is higher than that of the side part 15. The quantitative measures of oxygen contents are compared according to the aforementioned ZAF method. To be specific, the comparison of quantitative measures is performed by obtaining the oxygen content of the conductor region part 11 according to the ZAF method first, and then without changing the magnifications or any other setting, moving the view field so that the side part 15 is seen and obtaining the oxygen content in the same manner.

The oxygen content of the conductor region part 11 can be made higher than that of the side part 15 by setting the oxygen concentration lower. The side part 15 where no internal conductor is present takes in oxygen from outside the laminated body, which promotes formation of oxide film. By setting the oxygen concentration lower, however, less oxygen is taken in from the outside and consequently oxide film is formed thinner. This way, the magnetic permeability of the side part can be increased.

Preferably the internal conductor contains at least one of Ag and Cu. By using an internal conductor made of Ag or Cu, oxidization of the metal M that oxidizes more easily than Fe of the material grain, or that of the oxide on the surface of the material grain, can be accelerated to promote the formation of oxide film. Here, by applying heat treatment in an ambience of low oxygen concentration, the standard electrode potential difference between the internal conductor and the metal M that oxidizes more easily than Fe causes the metal M with greater oxidizing potential to be oxidized and at the same time Ag or Cu is reduced. In other words, by selecting an appropriate material to be used for the internal conductor, the resistance required at the conductor region part 11 can be achieved even when heat treatment is performed in an ambience of low oxygen concentration. In addition, the internal conductor exists as metal of low oxygen content, resulting in high conductivity. For this reason, the resulting component is subject to little loss due to electrical resistance and therefore achieves higher efficiency in a smaller body.

The following explains how the coil component proposed by the present invention is manufactured, or specifically a typical manufacturing method of laminated inductor is explained, although this method is not limited thereto. To manufacture a laminated inductor, first a doctor blade, die-coater, or other coating machine is used to coat the surface of base film made of resin, etc., with a premixed magnetic paste (slurry). The coated film is dried with a hot-air dryer or other drying machine to obtain a green sheet. The magnetic paste contains soft magnetic alloy grains and, typically, polymeric resin as binder, and solvent.

Preferably the magnetic paste contains polymeric resin as binder. The type of polymeric resin is not limited in any way, and may be polyvinyl butyral (PVB) or other polyvinyl acetal resin, etc., for example. The type of solvent in the magnetic paste is not limited in any way and a mixed solvent of ethyl alcohol and toluene, etc., may be used, for example. The blending ratios of soft magnetic alloy grains, polymeric resin, solvent, etc., in the magnetic paste, or the like, may be adjusted as deemed appropriate, and the viscosity, etc., of the magnetic paste can also be set by adjusting the foregoing.

For the specific method of coating the magnetic paste and drying it to obtain green sheets, any prior art may be referenced as deemed appropriate. Here, the material composition may be changed for each area of the coil component as mentioned above, in order to adjust the ratios of oxygen content and iron content in each area.

Next, a stamping machine, laser processing machine or other punching machine is used to punch the green sheets to form through holes in a specified arrangement. The arrangement of through holes is set so that, when the sheets are layered, internal conductors 21 are formed by the through holes filled with a conductor and by the winding patterns. For the through hole arrangement and conductor pattern shape for forming the internal conductor, any prior art may be referenced as deemed appropriate.

Preferably a conductive paste is used to fill the through holes and also to print conductor patterns. The conductive paste contains conductive material and, typically, polymeric resin as binder, and solvent.

Any grain size may be selected as deemed appropriate for the conductive material provided as conductor grains, but preferably their d50 is 1 to 10 μm. The volume-based d50 of the conductor grain is measured using a grain size/granularity distribution measuring machine of laser diffraction/scattering type (such as Microtrac by Nikkiso Co., Ltd.).

Preferably the conductive paste contains polymeric resin as binder. The type of polymeric resin is not limited in any way, and may be ethyl cellulose (EC) or other cellulose resin, etc., for example. The type of solvent in the conductive paste is not limited in any way, and butyl carbitol or other glycol ether, etc., may be used, for example. The blending ratios of conductive material, polymeric resin, solvent, etc., in the conductive paste, or the like, may be adjusted as deemed appropriate, and the viscosity, etc., of the conductive paste can also be set by adjusting the foregoing.

Next, a screen printer, gravure printer, or other printing machine is used to print the conductive paste on the surface of the green sheets, and then the sheets are dried using a hot-air dryer or other drying machine to form conductive patterns. The conductive paste is partially filled into the aforementioned through holes, as well, during printing. As a result, the conductive paste filled in the through holes, and the printed conductor patterns, constitute a shape of the internal conductor 21.

The obtained green sheets are layered so that the internal conductor 21 becomes spiraled, and then pressure is applied in the layering direction to pressure-bond the green sheets, after which the bonded sheets are cut to the sizes of coil components to form laminated bodies.

Before being heat-treated, the obtained laminated bodies are degreased in an ambience of low oxygen concentration or in air using a sintering furnace or other heating apparatus. This is done at an oxygen concentration in a range of 0.1 to 21% and temperature of 300 to 500° C. for 1 to 2 hours. Thereafter, the degreased laminated bodies are heat-treated in an ambience of low oxygen concentration. The heat treatment ambience should be an ambience of low oxygen concentration, with the oxygen concentration adjusted to a range of 0.0005 to 0.1% or preferably 0.0005 to 0.005%. In the process of raising temperature, preferably the temperature is kept at 300 to 500° C. for 1 to 600 minutes and then raised further thereafter. The maximum temperature is preferably 600° C. or above, or more preferably 600 to 850° C., and it is preferable to keep the maximum temperature for 0.5 hour or more, or more specifically for 0.5 to 5 hours.

Normally external terminals are formed after the heat treatment. Using a dip coater, roller coater, or other coating machine, a premixed conductive paste is applied on both of the length-direction ends of the laminated inductor, and the coated inductor is baked using a sintering furnace or other heating apparatus under the conditions of approx. 700° C. for approx. 1 hour, for example, to form external terminals. For the conductive paste for external terminals, the aforementioned paste for printing conductor patterns or any other similar paste may be used as deemed appropriate.

It is possible to manufacture coil components according to the so-called slurry build method. One example of the slurry build method, although this method is not limited thereto, involves printing a magnetic paste by screen printing, etc., to form magnetic printing film and then screen-printing a conductive paste on top to form conductor patterns. On top of this, the magnetic paste is screen-printed and coated by partially exposing the conductor patterns. Similarly, conductor patterns and magnetic printing film are alternately formed in a manner continuing to the partially exposed patterns mentioned above, and after the last magnetic printing film is coated, the layers are cut to the sizes of coil components to form laminated bodies. For the subsequent heating and other treatments of the laminated bodies thus obtained, the aforementioned methods can be adopted.

EXAMPLES

The present invention is explained in greater detail below using examples. It should be noted, however, that the present invention is not limited in any way to the modes described in these examples.

A laminated inductor was manufactured as described below. This is explained based on the schematic cross sectional view of the laminated inductor shown in FIG. 1.

For the respective magnetic bodies, the material grains listed in Table 1 were used. The material grains in the table were as follows: the FeSiCr (1) grain had a composition of Si by 3.5 percent by weight, Cr by 4.0 percent by weight, and Fe accounting for the rest, as well as an average grain size of 6 μm; the FeSiCr (2) grain had a composition of Si by 2.0 percent by weight, Cr by 2.0 percent by weight, and Fe accounting for the rest, as well as an average grain size of 6 μm; the FeSiAl grain had a composition of Si by 3.5 percent by weight, Al by 4.0 percent by weight, and Fe accounting for the rest, as well as an average grain size of 6 μm; the FeSi grain had a composition of Si by 3.0 percent by weight and Fe accounting for the rest, as well as an average grain size of 6 μm; and the Fe grain contained impurities by 0.4 percent by weight, with Fe accounting for the rest, and had an average grain size of 2 μm. Also, the magnetic body was manufactured as a mixture of FeSiCr (1) grains and FeSiAl grains blended at a ratio (by weight) of 60:40 in Example 7, as a mixture of FeSiCr (1) grains and FeSiCr (2) grains blended at a ratio (by weight) of 50:50 in Example 8, and as a mixture of FeSiCr (1) grains and Fe grains blended at a ratio (by weight) of 90:10 in Examples 10 and 11.

Conductor patterns and vias were provided to make a spiral-shaped coil conductor 21 wound by approx. 10.5 times. The respective coil conductors 21 were obtained by using the materials and applying the heat treatment as listed in Table 1. In each example, the volume-based d50 of the metal grain was 5 μm, and in Example 8, Ag-coated Cu grains were used.

The respective heat treatments were carried out under the ambiences listed in Table 1. The figures indicate oxygen concentrations, which were in a range of 0.0005 to 0.1% in the examples, and adjusted to 21, 1, and less than 0.00001 in the comparative examples. An oxygen concentration of less than 0.00001 was achieved using a mixture gas of nitrogen and hydrogen (nitrogen gas containing hydrogen by 1%). It should be noted that the respective laminated bodies were degreased prior to the heat treatment, based on an oxygen concentration of 1%, rate of rise in temperature of 100° C. per hour from normal temperature to 300° C., and holding time of 2 hours.

The laminated inductors were manufactured as described below.

A magnetic paste constituted by 85 percent by weight of alloy magnetic grains, 13 percent by weight of butyl carbitol (solvent), and 2 percent by weight of polyvinyl butyral (binder), was prepared. Using a doctor blade, this magnetic paste was applied on the surface of plastic base film, which was then dried with a hot-air dryer under the conditions of approx. 80° C. for approx. 5 minutes. This way, a green sheet on base film was obtained. Thereafter, the green sheet was cut.

Next, the sheets were punched as necessary to form through holes according to a specified arrangement. Thereafter, a printing machine was used to print the surface of the sheets as specified, and/or fill the through holes, with a conductive paste constituted by 85 percent by weight of metal grains, 13 percent by weight of butyl carbitol (solvent), and 2 percent by weight of ethyl cellulose (binder), and the printed/punched sheets were dried with a hot-air dryer under the conditions of approx. 80° C. for approx. 5 minutes.

Next, using a suction transfer machine and press machine, the respective sheets that had been printed and/or filled as necessary were layered in the specified sequence and then thermally bonded, after which the bonded sheets were cut to the sizes of coil components to obtain laminated bodies. Thereafter, a sintering furnace was used to heat-treat each laminated body at 700° C. for 1 hour in the specified ambience. This heat treatment caused the alloy magnetic grains to become densely packed to form a magnetic body, while causing the metal grains in the conductive paste to be sintered to form an internal conductor 21, and consequently a component body was obtained.

Next, external electrodes were formed. Using a coating machine, the surface of the component body was coated with the same conductive paste used for the internal conductor as mentioned above, constituted by 85 percent by weight of metal grains, 13 percent by weight of butyl carbitol (solvent), and 2 percent by weight of ethyl cellulose (binder), and the coated component was baked in a sintering furnace under the conditions of approx. 700° C. for approx. 0.5 hour. The baking ambience was adjusted to the same ambience used for heat treatment. As a result, the solvent and binder were removed and the metal grains were sintered. Thereafter, Ni/Sn plating was applied to form external electrodes, and a laminated inductor was completed.

The laminated inductor dimensions were 2.0 mm×1.2 mm×1.0 mm (in some embodiments, each dimension can be modified by ±50%). Also, the distances between the adjacent windings of the spiral shape of the conductor region part 11 were each set to 16 μm (in some embodiments, each distance can be modified by ±50%).

The characteristics of the laminated inductors in each of the examples and comparative examples are shown in Table 1.

TABLE 1

| | Metal grain for internal conductor | | | Oxygen concentration |
|---|---|---|---|---|
| | Material type | Average grain size [μm] | Metal grain for internal conductor | of heat treatment ambience [%] |
| Comparative Example 1 | FeSiCr (1) | 6 | Ag | 21 |
| Comparative Example 2 | FeSiCr (1) | 6 | Ag | 1 |
| Comparative Example 3 | FeSiCr (1) | 6 | Ag | <0.00001 |
| Example 1 | FeSiCr (1) | 6 | Ag | 0.1000 |
| Example 2 | FeSiCr (1) | 6 | Ag | 0.0100 |
| Example 3 | FeSiCr (1) | 6 | Ag | 0.0050 |
| Example 4 | FeSiCr (1) | 6 | Ag | 0.0005 |
| Example 5 | FeSiAl | 6 | Ag | 0.0050 |
| Example 6 | FeSiAl | 6 | Ag | 0.0005 |
| Example 7 | FeSiCr (1)/FeSiAl | 6/6 | Ag | 0.0005 |
| Example 8 | FeSiCr (1)/FeSiCr (2) | 6/2 | Cu/Ag | 0.0050 |
| Example 9 | FeSiCr (1) | 6 | Cu | 0.0050 |
| Example 10 | FeSiCr (1)/Fe | 6/2 | Ag | 0.0050 |
| Example 11 | FeSiCr (1)/Fe | 6/2 | Cu | 0.0005 |

(Evaluation Methods)

As for the oxygen content, quantitative measures were compared using EDS. As mentioned above, samples exposing the cross sections of the respective locations of the magnetic body, namely the conductor region part 11, core part 12, cover parts 13, 14, and side part 15, were prepared. On each cross section, the O/Fe ratio was obtained from the Fe and O (oxygen) detected per unit area using the SEM-EDS ZAF method. Here, the evaluation area at each location corresponded to an area of 0.05 mm×0.05 mm, when observed at ×200 magnifications, around the vertical and horizontal center at each location as determined by viewing the cover parts 13, 14 in the vertical direction (either cover part 13 or 14 may be on top). Using the value of the O/Fe ratio obtained here, the O/Fe ratio of the cross section of the core part 12 was obtained in relation to the O/Fe ratio of the cross section of the conductor region part 11, for comparison of oxygen content. Similarly, the O/Fe ratio of the cross section of the side part 15 was also obtained in relation to the O/Fe ratio of the cross section of the conductor region part 11. The oxygen contents obtained here were compared by obtaining the oxygen content of the core part in relation to the oxygen content of the conductor region part, and also by obtaining the oxygen content of the side part in relation to the oxygen content of the conductor region part.

As for the thickness of oxide film, the thickness of oxide film of the conductor region part 11 was evaluated using the aforementioned evaluation samples for oxygen content. First, a SEM (scanning electron microscope) was used at ×100 magnifications to determine the location corresponding to the center of the cross section of the conductor region part 11, and a magnetic grain close to the center was selected, in the same manner as described above. Next, by observing around this magnetic grain at ×10000 magnifications, a tangential line was drawn between this magnetic grain and another magnetic grain positioned adjacent to the selected magnetic grain via oxide film, and by viewing from the direction orthogonal to the tangential line, a line orthogonal to the tangential line was drawn to the part where the distance between the selected magnetic grain and the adjacent magnetic grain joined to it via oxide film becomes the closest, after which line analysis was conducted using an EDS (energy dispersion X-ray spectrometer) on this line. The range of analysis was set as 0.5 μm to both sides of the point of intersection between the tangential line and the orthogonal line, and by using the smaller of the O/Fe ratios at both ends as a reference, the length of the part where the value of O/Fe became 1.2 times the reference or more was obtained. This measurement was performed more than 10 times sequentially, starting from the magnetic grain closest to the center, and an average was obtained.

It should be noted that, in Comparative Example 3, there was no detectable thickness (indicated by "–" in Table 2).

Inductance measurement was performed using a LCR meter at a frequency of 1 MHz. In all of the examples and comparative examples, 10 samples were measured and an average was obtained. The evaluation results are shown in Table 2 below.

provide such conditions and/or structures, in view of the present disclosure, as a matter of routine experimentation. Also, in the present disclosure including the examples described above, any ranges applied in some embodiments may include or exclude the lower and/or upper endpoints, and any values of variables indicated may refer to precise values or approximate values and include equivalents, and may refer to average, median, representative, majority, etc. in some embodiments. Further, in this disclosure, "a" may refer to a species or a genus including multiple species, and "the invention" or "the present invention" may refer to at least one of the embodiments or aspects explicitly, necessarily, or inherently disclosed herein. The terms "constituted by" and "having" refer independently to "typically or broadly comprising", "comprising", "consisting essentially of", or "consisting of" in some embodiments. In this disclosure, any defined meanings do not necessarily exclude ordinary and customary meanings in some embodiments.

TABLE 2

| | Comparison of oxygen contents | | | |
|---|---|---|---|---|
| | Core part/Conductor region part | Side part/Conductor region part | Thickness of oxide film at conductor region part [nm] | Inductance [μH] |
| Comparative Example 1 | 1.00 | 1.09 | 130 | 0.90 |
| Comparative Example 2 | 1.00 | 1.05 | 125 | 0.91 |
| Comparative Example 3 | 1.00 | 1.00 | — | 0.10 |
| Example 1 | 0.78 | 1.00 | 131 | 1.04 |
| Example 2 | 0.68 | 1.00 | 121 | 1.06 |
| Example 3 | 0.59 | 0.86 | 119 | 1.11 |
| Example 4 | 0.60 | 0.80 | 110 | 1.13 |
| Example 5 | 0.60 | 1.12 | 155 | 1.03 |
| Example 6 | 0.54 | 0.88 | 143 | 1.10 |
| Example 7 | 0.64 | 0.91 | 130 | 1.12 |
| Example 8 | 0.60 | 0.92 | 143 | 1.10 |
| Example 9 | 0.62 | 0.85 | 118 | 1.13 |
| Example 10 | 0.63 | 0.97 | 140 | 1.08 |
| Example 11 | 0.58 | 0.90 | 133 | 1.11 |

By applying heat treatment in an ambience of low oxygen concentration, material grains containing Fe at high percentage can be used. As a result, the percentage of Fe in the magnetic body can be adjusted to a range of 92.5 to 97 percent by weight, which in turn boosts the saturation characteristics and raises the saturation current of the coil component compared to before. This consequently helps reduce the thickness of the coil component.

Additionally, while lowering the oxygen concentration for heat treatment makes the oxide film on the surface of the component body thinner overall, phosphate treatment can be given after the heat treatment. This way, the oxide film can be reinforced as the phosphate treatment forms a phosphate compound, even when the oxide film is thin in some areas and should there be defects characterized by non-formation of oxide film. Consequently, the reliability improves.

In addition, even when the oxygen content of the conductor region part of the magnetic body is different from that of the core part, heat-treating in an ambience of low oxygen concentration slows the rate of formation of oxide film, which suppresses generation of cracks, etc., due to thermal expansion and the like. This enables thickness reduction, in addition to characteristic improvement, in that the thickness of the coil component can be reduced without causing the reliability to drop despite a narrower conductor region part spacing.

In the present disclosure where conditions and/or structures are not specified, a skilled artisan in the art can readily The present application claims priority to Japanese Patent Application No. 2015-073481, filed Mar. 31, 2015, the disclosure of which is incorporated herein by reference in its entirety including any and all particular combinations of the features disclosed therein.

It will be understood by those of skill in the art that numerous and various modifications can be made without departing from the spirit of the present invention. Therefore, it should be clearly understood that the forms of the present invention are illustrative only and are not intended to limit the scope of the present invention.

We claim:

1. A coil component comprising:

a magnetic body, and an internal conductor having a center axis and formed in a spiral shape wound around the center axis, wherein:

the internal conductor is embedded in the magnetic body;

in a cross sectional view of a plane that includes the center axis extending in a vertical direction, the magnetic body can be divided into:

(1) a conductor region part positioned between, in the vertical direction, every adjacent windings of the spiral shape;

(2) a core part including the center axis and positioned on an inward side of the spiral shape of the windings and surrounded by the spiral shape of the windings around the center axis;

(3) cover parts positioned below a bottom edge, and above a top edge, of the spiral shape; and (4) a side part positioned on an outward side of the spiral shape of the windings and surrounding the spiral shape of the windings around the center axis;

the magnetic body is constituted by iron-based soft magnetic grains and oxide film of at least one type of element that oxidizes more easily than iron, where bonding of the iron-based soft magnetic grains positioned adjacent to each other is formed at least partly by the oxide film; and an oxygen content of the conductor region part of the magnetic body is higher than that of the core part and also higher than that of the side part, whereby the oxygen content of the conductor region part is higher than that of an inward side closer to the central axis than is the conductor region part, as well as that of as an outward side further away from the central axis than is the conductor region part.

2. A coil component according to claim 1, wherein the internal conductor contains at least one of Ag and Cu.

3. A coil component according to claim 1, wherein the bonding of the iron-based soft magnetic grains is formed by degreasing iron-based soft magnetic grains at a temperature of 300° C. to 500° C. in an atmosphere having an oxygen concentration of more than 0.1% and no more than 21%, and then heating the degreased iron-based soft magnetic grains at a temperature of 600° C. to 850° C. in an atmosphere having an oxygen concentration of no less than 0.0005% but no more than 0.1%.

* * * * *